US005584316A

United States Patent [19]

Lund

[11] Patent Number: 5,584,316

[45] Date of Patent: Dec. 17, 1996

[54] HYDROTHERMAL STABILIZER AND EXPANSION TANK SYSTEM

[75] Inventor: William J. Lund, Stockton, Calif.

[73] Assignee: ACT Distribution, Inc., Newport Beach, Calif.

[21] Appl. No.: 461,670

[22] Filed: Jun. 5, 1995

Related U.S. Application Data

[63] Continuation-in-part of Ser. No. 219,973, Mar. 30, 1994.

[51] Int. Cl.[6] ..... F16K 49/00

[52] U.S. Cl. ..... 137/337; 126/362

[58] Field of Search ..... 237/66; 137/337; 126/362; 417/12, 32

[56] References Cited

U.S. PATENT DOCUMENTS

| | | | |
|---|---|---|---|
| 2,823,695 | 2/1958 | Coffin | 126/362 |
| 3,754,563 | 8/1973 | Boals | 126/362 |
| 4,518,007 | 5/1985 | Haws | 137/337 |
| 4,930,551 | 6/1990 | Haws | 137/337 |
| 4,945,942 | 8/1990 | Lund | 137/337 |
| 5,042,524 | 8/1991 | Lund | 137/337 |

*Primary Examiner*—A. Michael Chambers
*Attorney, Agent, or Firm*—Walter A. Hackler

[57] ABSTRACT

Plumbing apparatus is provided for reducing energy consumption and controlling increases in water pressure of a hot water heater. The apparatus includes a tank and a buoyant piston movably disposed within the tank and having a perimeter slidably engaging an inside wall of the tank. Water entering a top of the tank pushes the buoyant piston towards a bottom of the tank and at a selected position, grooves are provide in an inside wall of the tank to enable entering water to pass the buoyant piston. When the apparatus is connected between a conventional hot water heater and a cold water source, the water heater is buffered from the cold water source for small draws of water from the hot water heater thus preventing such small draws of water from tripping the water heater thermostat. The buoyant piston is designed to enable expansion of tank capacity such that upon increases in water volume due to thermal expansion, pressure within the tank is controlled and rupture of the tank is prevented.

17 Claims, 4 Drawing Sheets

HYDROTHERMAL STABILIZER AND EXPANSION TANK SYSTEM

This application is a continuation in part of pending U.S. patent application Ser. No. 08/219,973, filed on Mar. 30, 1994.

The present invention is generally directed to plumbing systems and appliances and more particularly directed to plumbing systems and appliances of high thermal efficiency and safety.

As described in U.S. Pat. Nos. 4,321,943 and 4,798,224, a considerable amount of thermal energy may be wastefully dissipated from hot water lines which provide hot water to plumbing fixtures, such as domestic wash basins, dishwashers and clothes washers. In addition, if water is allowed to run down the drain while waiting for hot water to be delivered to the fixture from a remote hot water source, a substantial water loss may occur.

In order to reduce such water loss, plumbing systems have been devised which continuously circulate hot water from a hot water source to the fixture and back to the hot water source. In this arrangement, a supply of hot water is always adjacent to a plumbing fixture despite the remote position of the hot water source. The water loss is then limited to the amount of cold water disposed in draw pipes interconnecting the plumbing fixture to the hot water conduit in which hot water is circulated.

While this system substantially reduces the amount of water which must be withdrawn from the fixture before suitable hot water is obtained, it is not energy efficient because the array of pipes interconnecting the plumbing fixtures in the hot water source provide an enormous surface area for thermal radiation therefrom. In addition, the electrical cost of running a circulating pump may cause such system to be prohibitive in view of the latest energy conscious code requirements of most governmental agencies.

Thermal losses in both circulating and noncirculating plumbing systems have been reduced by insulation of the hot water lines as well as the hot water heaters which feed the plumbing fixtures. While such insulation slows the dissipation of heat, no savings occur over an extended period of time in noncirculating systems because intermittent use of hot water through the lines still allows hot water to cool to ambient temperatures. In circulating systems, of course, there is a continual thermal loss.

With specific reference to noncirculating systems, devices have been developed to actually recover the hot water remaining in the hot water lines after the use of a fixture by drawing the hot water back into the hot water tank; e.g., see U.S. Pat. Nos. 4,321,943 and 4,798,224. Because hot water is removed from the lines, there is an actual reduction in the amount of heat loss rather than just a slowing of heat loss as occurs through the use of insulation alone.

U.S. Pat. No. 5,042,524 is directed to an accelerated hot water delivery system which substantially reduces thermal losses by providing intermittent circulation through the hot water lines and U.S. Pat. No. 5,277,219 teaches a hot water demand system suitable for retrofit in existing plumbing installations.

In addition to the considerations hereinabove set forth with regard to the operation of pumping devices, it is well known that most hot water usages in the home are small uses of less than two gallons. In a conventional installation, the incoming cold water that replaces the outgoing hot water from the hot water tank is directed to the bottom of the tank and in many cases, a small usage of water trips the thermostat causing the water heater to turn on, heating the water unnecessarily.

The present invention overcomes this inherent problem in the prior art hot water systems by buffering the hot water tank thermostat from small draws of water. In addition, the present invention may also utilize the cold water line as a return line for hot water loop. This enables the present invention to be readily retrofitted into existing homes without need for installation of a return line to the hot water heater similar to that set forth in U.S. Pat. No. 5,277,219, hereinabove cited.

Another disadvantage of conventional installations is the lack of adequate means of controlling increases in water pressure due to thermal expansion of water with in the water heater tank. Conventional water heater tanks commonly include emergency pressure relief valves that are designed to release excess hot water within the tank in the event of a serious rise in water pressure. Once a relief valve is activated, heated water is expelled out of the valve and is lost onto a floor or down a drain. Notably, relief valves are not designed to withstand frequent operation, and in the event that pressure conditions in a water tank cause the relief valve to open regularly, as is often the case, the relief valve may wear and corrode prematurely, and eventually become inoperable. Without a reliable emergency pressure relief device on a hot water tank, excessive water pressure can cause the tank or connecting pipes to rupture. The present invention prevents this potentially dangerous situation from occurring by controlling pressure within the water heater tank such that the pressure remains at a normal, safe operating range, well below the emergency setting on a pressure relief valve.

SUMMARY OF THE INVENTION

Plumbing apparatus for reducing energy consumption of a hot water tank in accordance with the present invention generally includes a tank means for containing water with the tank having a top with a water inlet and a bottom with a water outlet therein.

A buoyant piston is movably disposed within the tank means and has a perimeter slidably engaging an inside wall of the tank means.

Water entering the tank means through the water inlet pushes the buoyant piston downward to a selected lower position, and means are provided for enabling the water entering the water inlet to pass by the buoyant piston and to the tank means water outlet when the buoyant piston is displaced to the selected lower position. Importantly, the buoyant piston has sufficient buoyancy to rise to the tank means top from the selected lower position when the water is not entering the tank means water inlet.

When the plumbing apparatus hereinabove described is interconnected between a cold water source and a conventional hot water tank, the plumbing apparatus acts as a hydrothermal stabilizer which buffers the hot water tank thermostat from small draws of water. That is, when a hot water tap is opened, cold water pushes the buoyant piston downward to the selected position. Hence, for hot water draws smaller than the volume of the tank means, the water heater will not turn on; consequently, the average temperature of the tank becomes lower, reducing energy consumption accordingly.

When the hot water is shut off, the buoyant piston rises to the top above the tank means, as hereinabove described, allowing water above the piston to pass between the wall of the buoyant piston and the inside wall of the tank means.

Importantly, when the tank means is disposed above a water heater, water in the tank means below the buoyant piston is warmed by thermocycling. Thus, the warm water below the piston forced into the water heater by incoming cold water above the buoyant piston, further reduces the likelihood of the hot water tank thermostat turning on in response to a small draw of water.

In another embodiment of the present invention, crossover pipe means are provided for interconnecting a hot water line, connected to a hot water tank out let, and a cold water source for enabling cold water from the cold water line to pass into the hot water line as the buoyant piston rises in the tank means. In this manner, the tank means can be utilized to recover hot water from the piping system after each hot water draw. Thus, as the buoyant piston rises in the tank means, it pushes cold water into the cold water line through the crossover means into the hot water line, and the hot water in the hot water line is pushed back into the hot water tank.

The present invention also may be used in combination with a pump-powered water recovery system. In this embodiment, a hot water heater is provided having a water inlet and a water outlet, along with a hot water delivery line connected between the hot water heater and at least one plumbing fixture. An equal water delivery line is provided, connected between the plumbing fixture and a cold water source.

A pump interconnected between the hot and cold water delivery lines, at a point remote from the hot water heater, provides a means for circulating water from the hot water delivery line through the cold water delivery line and into the hot water heater. Control means are provided for causing the pump to circulate water from the hot water line into the cold water line proximate the plumbing fixture and back into the hot water heater when a hot water valve on the plumbing fixture is turned on. A temperature sensor means connected to the control means is provided for causing the control means to stop the pump to prevent heated water from being circulated through the cold water delivery line.

In combination, tank means are provided for containing water with the tank means having a tow with the water inlet therein connected to the cold source and a bottom cold water outlet therein connected to the hot water heater inlet.

A buoyant piston is provided, movably disposed within the tank means with a perimeter sealingly engaging an inside wall of the tank means. Means are provided for enabling the water entering the tank means water inlet to pass by the buoyant piston when the buoyant piston is displaced to a selected lower position in the tank means by the entering water. Importantly, the buoyant piston has sufficient buoyancy to rise to the tank means top from the selected lower position when the water is not entering the tank means water inlet. Thus, this embodiment provides hydrothermal stabilization of water in the hot water heater for accommodating small draws of water, and yet at the same provides a rapid hot water demand system and, additionally, recovery of hot water remaining in hot water lines following the use of hot water.

The buoyant piston is generally hollow and includes means for controlling increases in water pressure due to thermal expansion of water in the hot water heater. For example, the lower surface of the piston may be comprised of a flexible diaphragm which separates water in the tank from a compressible air cushion in the piston. In particular, the diaphragm is adapted to flex into the air cushion, in response to a rise in water pressure, thus effectively expanding the water capacity of the tank and consequently, relieving water pressure in both the water heater and tank means. By keeping water pressure stabile, the diaphragm prevents potential rupture of the tank means due to excessive water pressure.

Preferably, the diaphragm forms the lower surface of an air filled bladder, disposed within the piston. Because the bladder if filled with air, it is compressible and is able to accommodate water expansion in the tank means.

More particularly, when the piston is floating at the top of the tank, for example, when hot water is not being drawn from the system, the water heater will begin to create thermal expansion of water in the water tank. As the water expands, water pressure within the tank is increased. As a result, the lower surface of the bladder will flex toward the interior of the piston effectively relieving water pressure within the tank.

BRIEF DESCRIPTION OF THE DRAWINGS

The advantages and features of the present invention will be better understood by the following description when considered in conjunction with the accompanying drawings in which.

DETAILED DESCRIPTION

Figure 1:
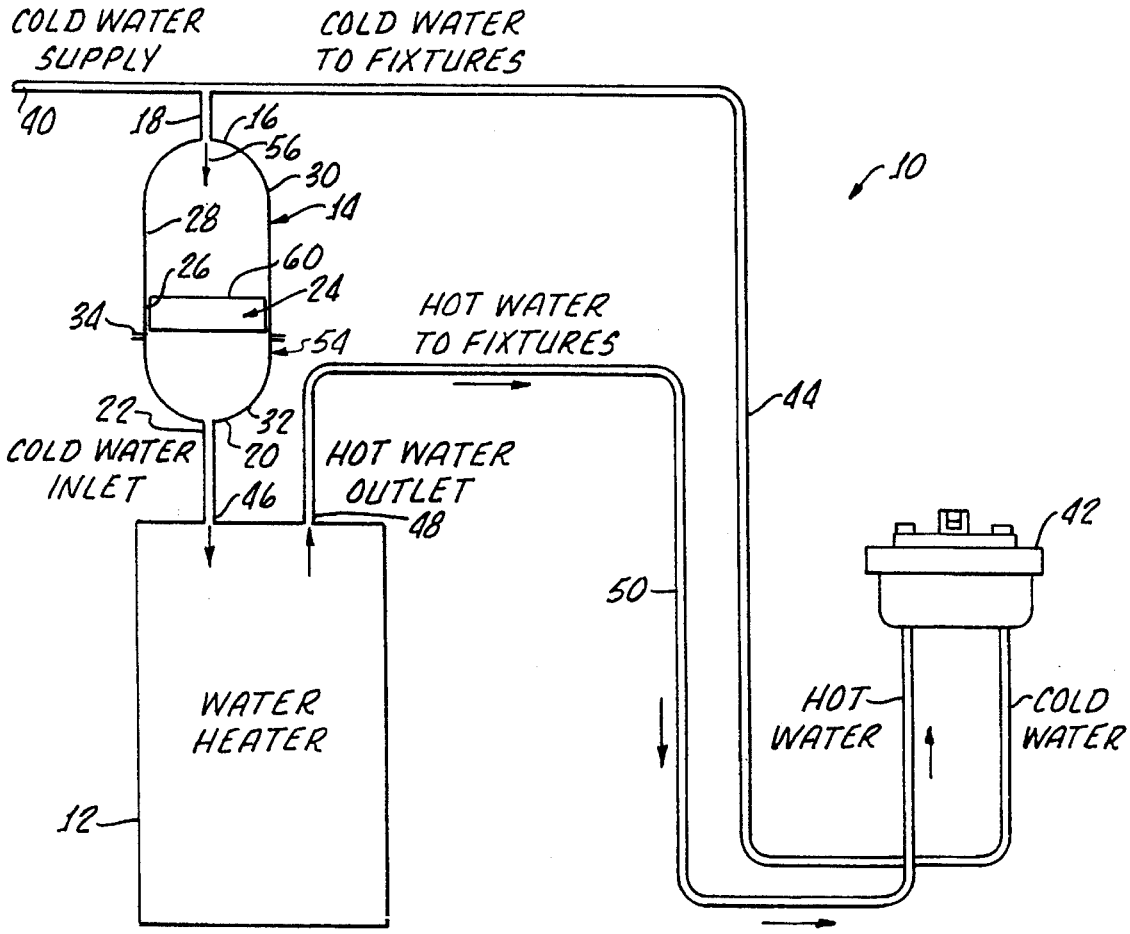
FIG. 1 is a flow diagram of plumbing apparatus in accordance with the present invention, generally showing a hydrothermal stabilizer tank interconnected between a cold water supply and a water heater for buffering the water heater from small draws of water as hereinafter described.

Turning now to FIG. 1, there is shown plumbing apparatus 10 for reducing energy consumption of a hot water heater 12, in accordance with the present invention, which generally includes a tank 14 which provides a means for containing water. The tank 14 includes a top 16 having a water inlet 18 therein and a bottom 20 having a water outlet 22 therein.

Disposed within the tank 14 is a buoyant piston 24 having a perimeter 26 slidably engaging an inside wall 28 of the tank 14. The tank 14 may be of unit construction or fabricated in a top section 30 and a bottom section 32 which may be joined by a flange 34.

The tank 14 and piston 24 may be formed from any suitable material such as plastic or the like with the piston 24 being hollow and of sufficient buoyancy to rise in the tank 14 when the latter is filled with water.

The tank inlet is connected to a cold water supply 40 which also provides cold water to a fixture 42 via a cold water delivery line 44. The outlet 22 is connected to a water heater inlet 46 and a hot water outlet 48, and the hot water heater 12 is interconnected to the fixture 42 by a hot water delivery line 50.

Figure 2:
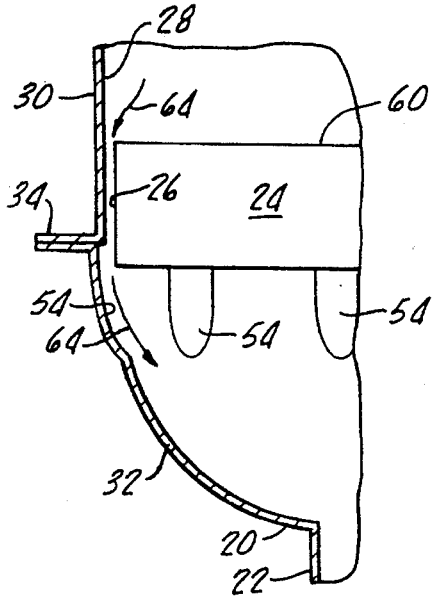
FIG. 2 is an enlarged portion of the hydrothermal stabilizer tank showing a plurality of grooves for allowing water to pass by a buoyant piston when the buoyant piston is displaced to a selected lower position in the hydrothermal stabilizer tank.

Turning to FIG. 2, there is shown a plurality of grooves 54 formed in the inside wall 26 which provide a means for enabling water entering the water inlet, as indicated by the arrow 56 in FIG. 1, to pass by the buoyant piston 24 when the buoyant piston is displaced to a selected position proximate the flange 34 as shown in FIGS. 1 and 2. The entering water 56 forces, or pushes, the piston 24 from a position near the top 16 of the tank 14 to the selected position. Since a top 60 of the piston provides greater surface area than the gap between the perimeter 26 and the wall 28 to the incoming water, the piston 24 is pushed to the selected position as shown in FIGS. 1 and 2. The grooves 54 are-sized and are of an appropriate number to allow the entering water 56 to freely pass the piston at the selected position as shown by the arrow 64. Thus, when the piston 24 is at or near the bottom 20 of the tank 14, the water flows past the piston and into the water heater 12 via the water heater inlet 26 and tank outlet 22.

Importantly, the buoyant piston 24 has sufficient buoyancy, for example, by means of an air volume therein, to rise to the tank means top 16 from the selected lower position when water is not entering the tank means or water inlet 18.

Because the tank 14 is mounted above the water heater 12, the water in the lower portion 32 of the tank beneath the piston is heated by thermocycling. Consequently, a small draw of hot water, less than two gallons, can be supplied to the water heater 12 by downward displacement of the piston 24 in the tank 14, which is preferably larger than two gallons. Naturally, the size of the tank 14 may vary, depending upon the water heater capacity and the water capacity of the delivery line 50.

Consequently, for hot water draws smaller than the volume of the tank 14, the water heater will not turn on, and therefore the average temperature in the water heater 12 is lower, resulting in reduced energy consumption. Once the hot water is shut off at the fixture 42, the piston 24, being lighter than water, rises to the top of the tank 14, allowing water from above the piston 24 to pass between the wall 28 of the tank and the piston perimeter 26.

Figure 3:
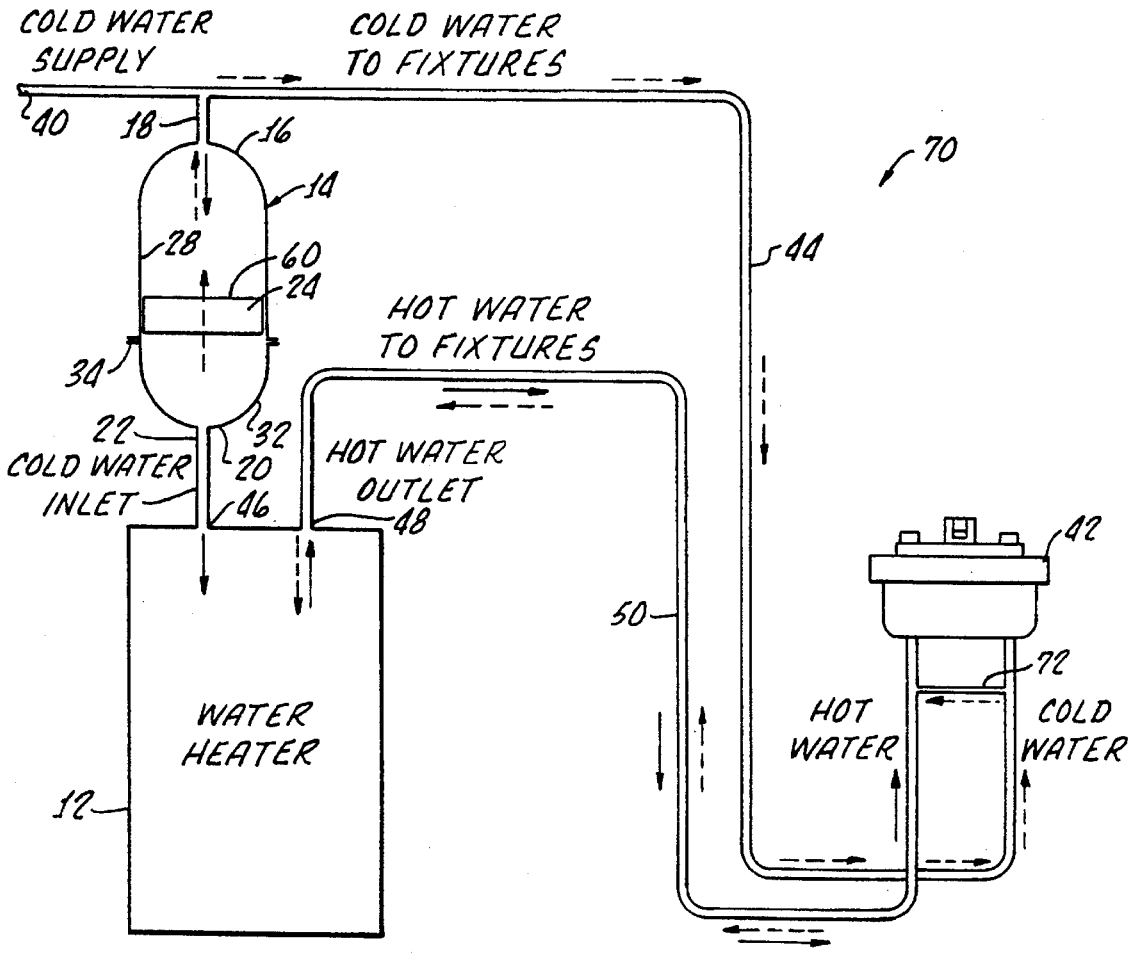
FIG. 3 is a flow diagram similar to FIG. 1 showing a crossover pipe interconnecting a hot water supply line and a cold water supply line proximate a fixture for enabling the hydrothermal stabilizer tank to recover hot water from the hot water line after use.

Turning now to FIG. 3, there is shown another embodiment 70, in accordance with the present invention, wherein like reference numerals or characters refer to identical corresponding parts thereof in similar views. More particularly, as illustrated in FIG. 3, there is shown a crossover pipe 72 connected between the cold water line 44 and hot water line 50 proximate the fixture 42, which provides a means for enabling cold water from the cold water line to flow into the hot water line as the buoyant piston 24 rises in the tank means. In this embodiment, an additional seal 76 (see FIG. 2) may be provided to ensure that as the piston 24 rises to the top 30 of the tank 14, water is pulled through the hot water line 50 and into the hot water outlet 48 of the water heater 12 via the crossover pipe 72 from the cold water line 44 and source 40. Thus, the hot water in the hot water line is pushed back into the hot water heater, recovering significant thermal energy. The advantages of the system are readily apparent since the tank 14 and piston 24 therein need no additional power requirements such as a pump, or the like, for recovering water from the hot water line. Thus, the hydrothermal stabilizer tank 14 also provides hot water recovery.

Figure 4:
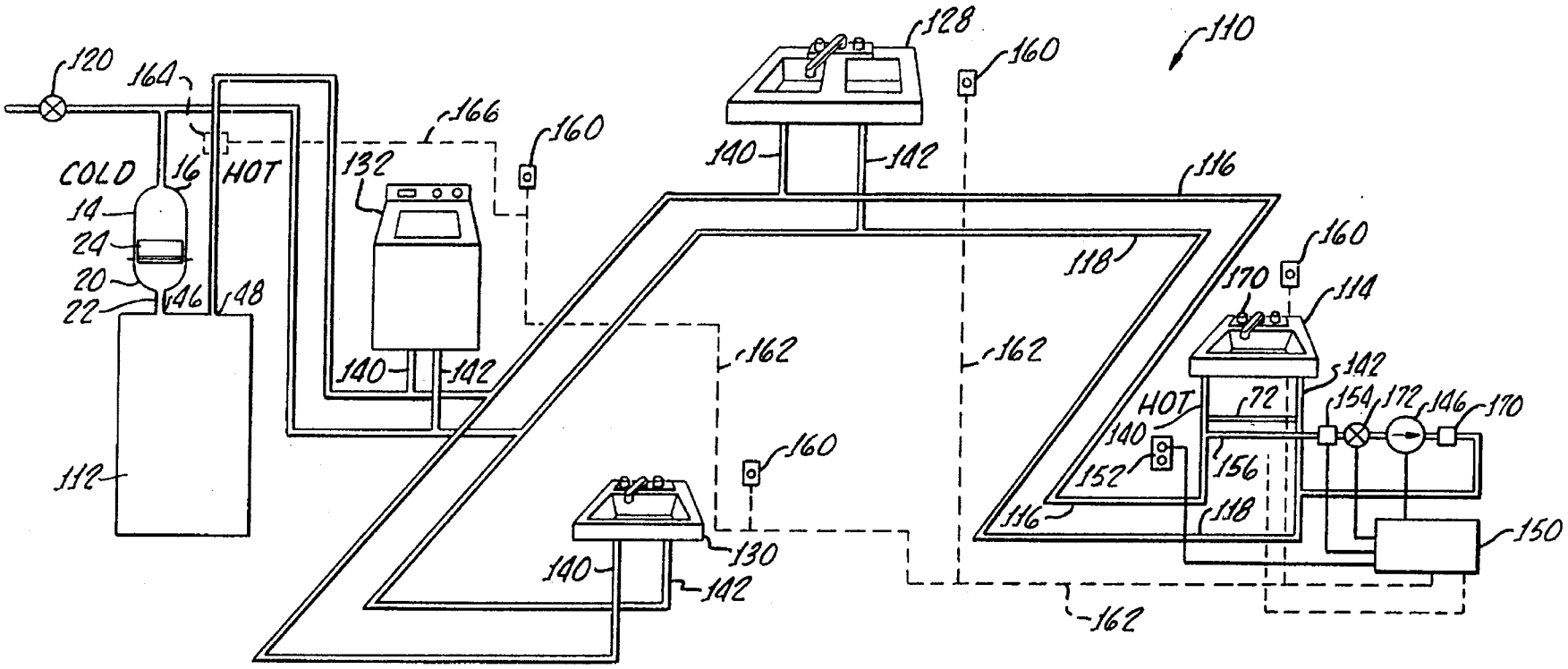
FIG. 4 is a flow diagram of a plumbing system in accordance with the present invention showing the hydrothermal stabilizer tank in combination with a hot water heater and conduit means, in combination with at least one plumbing fixture, along with a pump, flow switch and the controller.

This system is further compatible with a demand hot water system 110 as shown in FIG. 4. Again, like reference numerals or characters refer to identical corresponding parts throughout the several views and embodiments, as shown in FIGS. 1–4.

FIG. 4 shows a hot water recovery system 110 which generally includes a hot water source, such as a gas or electric hot water heater 112, connected to a plumbing fixture such as a sink 114 by a hot water delivery line 116. It is to be appreciated that the hot water heater 112 may be a conventional heater 12 as shown or an apparatus as described in U.S. Pat. No. 4,798,224, entitled "Automatic Hot Water Recovery System," or that shown in U.S. Pat. No. 5,042,524, entitled "Demand Recovery System". Also provided in the conventional manner is a cold water delivery line 118 interconnecting the sink 114 with a cold water source 120 which is also interconnected with the hot water heater 112 via a feed line 122.

Optional plumbing fixtures such as sinks 128,130 and washing machine 132 may be provided along with any other common plumbing fixture utilized in residences and businesses, all such fixtures being connected in a parallel configuration with the hot water delivery line 116 and cold water delivery line 118 by feed lines 140 and 142, respectively. At a selected plumbing fixture, such as the sink 114 which is most remote from the hot water heater 112, a pump 146 is interconnected between the hot water delivery line 116 and the cold water delivery line 118 via the feed lines 140 142 respectively. The pump provides means for circulating water from the hot water delivery line 116 through the cold water delivery line 118 and back into the hot water heater 112 via line 122, by utilizing the cold water delivery line as a return feeder to the hot water heater 112. No separate circulation line need be implemented in new systems.

The hot water delivery system 110 of the present invention can be used in conjunction with an existing system, which may include the hot water heater 112, hot and cold water delivery lines 116 118, and a plumbing fixture 114. In this instance, the pump 146 and controller 150, to be described hereinafter in greater detail, may be installed proximate fixture 114 without disturbing the remainder of the existing plumbing system. The advantages of this embodiment are significant in that no unwanted disruption of the housing or business structure is needed in order to implement the hot water recovery system in accordance with the present invention.

The control system 150, which may be of any common electrical type employing relays or solid state electronics or microchips, provides a means for switching electrical current outlet 152 to the pump 146 in order to cause the pump 146 to circulate water from the hot water line 116 to the cold water line 118.

A temperature sensor 154 is disposed in a line 156 interconnecting the pump 146 with the hot water delivery line 116 through the feeder 140, providing means for causing the control means to stop the pump 146 to prevent heated water from being circulated through the cold water delivery line 118 as will be hereinafter described. The temperature sensor 154 may be of a conventional type inserted into the line 156 for water flow thereover, or it may be a thermistor type of detector strapped to the outside of the line 156. The sensor 154 may be of a type for detecting a selected water temperature and in response thereto causing the control system to stop the pump 146.

However, it has been found that the sensitivity of such sensors may not be sufficient to prevent unwanted hot water from entering the cold water delivery line 118. Thus, the preferred embodiment of the present invention is a temperature sensor 154 which is configured for detecting a temperature increase, or gradient, such as one or two degrees and in response thereto, causing the control system 152 stop 146. Thus, no matter what the actual temperature of the water in the line 156 is, an increase of one or two degrees will cause the pump 146 to stop. The pump 146 is started through the control system 150 by means of optional manual switches 160 electrically connected to the control system 150 by way of wires 162 for causing the control system to turn on the pump 146, the control system in this manner acting as a relay switch. Alternatively, to reduce electrical wiring costs, a flow detector 164 may be disposed in the hot water delivery line 118 at any position and connected to the control system by an electrical wire 166 for causing the control system 152 to turn on the pump 146 in response to a detection of a water flow in the hot water delivery line 116.

Although the flow detector 164 is shown adjacent to the hot water heater 112, it may be alternatively disposed in the line 140 beneath the fixture 114 for reducing the electrical interconnection required and for enabling all of the apparatus of the present invention to be disposed beneath the fixture 114. Either the manual switches 160 or flow detector 164 enables the control means 152 to turn on the pump 146 when a hot water valve 70 on the fixture 114 is turned on, thus causing a flow in the hot water delivery line 116.

It should be appreciated that if the pump 146 is not a positive displacement type which does not allow water to flow in a reverse manner through it, then a one-way valve 170 should be provided to prevent such flow and preferably a solenoid 172, controlled by the control system 150, should be inserted upstream of the pump 146 to prevent water flow through the pump 146 when the control system 150 turns off pump 146.

It should also be appreciated that the temperature sensor 152 should be disposed in the hot water line or attached to it as hereinbefore described to prevent a rescission between the hot water delivery line 116 and the cold water delivery line 118. However, the pump can be located anywhere throughout the system 110 between the hot water delivery line 116 and cold water delivery line 118.

Following use of hot water, the crossover pipe 72 enables hot water remaining in the hot water delivery line 116 to return to the heater 112 as the buoyant piston 24 rises to the top 16 of the tank 14 by replacing water in the hot water line by water from the cold water line 118 as earlier set forth.

Figure 5:
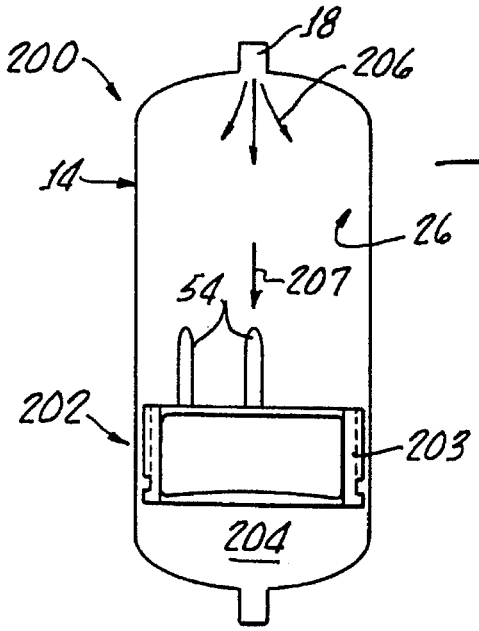
FIG. 5 shows a cross-sectional view of the hydrothermal stabilizer tank of FIG. 1, including an alternative buoyant piston having an air filled bladder for controlling water pressure due to thermal expansion of hot water in the tank.
Figure 5A:
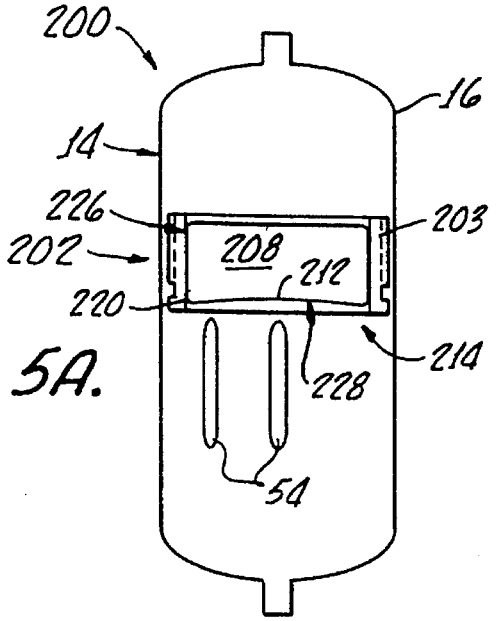
FIG. 5A shows a cross-sectional view of the buoyant piston of FIG. 5, rising to the top of the hydrothermal stabilizer tank.
Figure 5B:
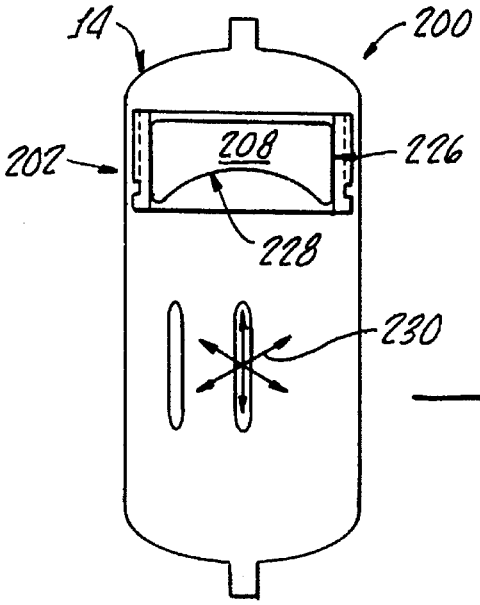
FIG. 5B shows a cross-sectional view of the buoyant piston of FIG. 5 and the air filled bladder flexing inward in order to enable thermal expansion of water within the hydrothermal stabilizer tank.

Turning now to FIGS. 5, 5A and 5B, another embodiment 200 of the present invention is shown, utilizing tank 14 and an alternative buoyant piston 202, including means 203 for controlling pressure increases within the tank 14, and preventing rupture of the tank 14 due to hydrothermal expansion therein.

Referring now to FIG. 5, as hereinabove described, when hot water is drawn from the system, for example by way of a remote hot water tap (not shown), the level of hot water 204 in the tank 14 will drop and at the same time, cold water, as indicated by arrows 206, will flow through the cold water inlet 18 into the tank 14. Consequently, the buoyant piston 202 will be forced downward in the direction of arrow 207 to a selected lower position as shown.

Subsequently, due to the buoyancy of the piston 202 and grooves 54 on the inside wall 26 of the tank 14, the piston 202 will slowly rise to the top 16 of the tank 14, as shown in FIG. 5A. After a period of time wherein little or no hot water is drawn from the system, the water 204 below the piston 202 will be warmed by thermocycling and will reach a temperature substantially equal to the temperature of water in the hot water heater below (not shown in FIGS. 5, 5A, and 5B). As water is heated, it naturally expands in volume. Thus, in order to accommodate the increase in water volume, an air cushion 208 is provided, disposed within the piston 202, for accommodating expansion of the water. For example, a flexible diaphragm 212 is provided to along a lower surface 214 of the piston 202 such that the diaphragm 212 separates hot water 204 below the piston 202 from the compressible air cushion 208. The diaphragm 212 is sealed along the perimeter 220 of the piston 202 in order to prevent contact between hot water 204 and the air cushion 208. Consequently, dissolution of the air cushion 208 by hot water 204 in the tank 14 is prevented.

Preferably, the air cushion 208 is enclosed within a bladder 226, and the diaphragm 212 forms the lower surface 228 thereof. Unlike the expanding hot water 204, the air cushion 208 within the bladder 226 is compressible. Referring now to FIG. 5B, it is shown the effective water capacity of the tank 14 is increased when water pressure (represented by arrows 230) due to hydrothermal expansion forces the lower surface 228 of the bladder 226 inward. Because the effective water capacity of the tank 14 can be expanded by means of the air cushion, water pressure in the tank 14 remains stable. Importantly, the flexible, compressible bladder 226 within the piston functions to prevent rupture of the tank 14, water heater tank, and connecting pipes (not shown), due to hydrothermal expansion. The bladder 226 may be formed of any suitable material, for example, heavy gauge synthetic rubber.

Although there has been hereinabove described a particular arrangement of a hydrothermal stabilizer and expansion tank system in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. Plumbing apparatus for reducing energy consumption and controlling water pressure of a hot water heater, said plumbing apparatus comprising:

tank means for containing water, said tank means having a top with a water inlet therein and a bottom with a water outlet therein;

a buoyant piston having an air volume therein, and said piston being movably disposed within said tank means and having a perimeter slidably engaging an inside wall of said tank means;

means for enabling water entering the water inlet to pass by the buoyant piston when the buoyant piston is displaced to a selected lower position in said tank means by the entering water, said buoyant piston having sufficient buoyancy to rise to the tank means top from the selected lower position when water is not entering the tank means water inlet; and means, disposed within the buoyant piston, for controlling increases in water pressure due to thermal expansion of water in the tank means.

2. The plumbing apparatus according to claim 1 wherein the means for controlling increases in water pressure includes air cushion means for accommodating expansion of water in the tank means.

3. The plumbing apparatus according to claim 2 wherein the air cushion means comprises a diaphragm.

4. The plumbing apparatus according to claim 2 wherein the air cushion means comprises a flexible bladder.

5. The plumbing apparatus according to claim 1 further comprising means for connecting the tank means between a hot water heater inlet and a cold water source and crossover pipe means for interconnecting a hot water line, connected to a hot water tank outlet, and a cold water line, connected to a cold water source, for enabling cold water from the cold water line to flow into the hot water line as the buoyant piston rises in the tank means.

6. A hot water recovery and expansion system comprising:

a hot water tank having a water inlet and a hot water outlet;

a hot water delivery line connected said hot water outlet and at least one plumbing fixture;

a cold water delivery line connected between said plumbing fixture and a cold water source;

crossover pipe means, connected between said hot and cold water delivery lines, for enabling cold water to flow from the cold water delivery line into the hot water delivery line, said crossover pipe being disposed at a point remote from said hot water source;

tank means for containing water, said tank means having a top with a water inlet therein connected to the cold water source and a bottom with a water outlet therein connected to the hot water tank inlet;

a buoyant piston having an air volume therein, and said piston being movably disposed within said tank means and having a perimeter slidably engaging an inside wall of said tank means, said buoyant piston including;

means for enabling water entering the water inlet to pass by the buoyant piston when the buoyant piston is displaced to a selected lower position in said tank means by the entering water, said buoyant piston having sufficient buoyancy to rise to the tank means top from the selected lower position when water is not entering the tank means water inlet and draw hot water from the hot water source and hot water delivery line into the tank means below the buoyant piston, water from the hot water delivery line being supplied through the crossover pipe from the cold water delivery line; and means, disposed within the buoyant piston, for controlling increases in water pressure due to thermal expansion of water in the tank means.

7. The hot water recovery and expansion system according to claim 6 wherein the means for controlling increases in water pressure includes air cushion means for accommodating expansion of water in the tank means.

8. The hot water recovery and expansion system according to claim 7 wherein the air cushion means comprises a diaphragm.

9. The hot water recovery and expansion system according to claim 7 wherein the air cushion means comprises a flexible bladder.

10. Plumbing apparatus for reducing energy consumption of a hot water heater, said plumbing apparatus comprising:

tank means for containing water, said tank means having a top with a water inlet therein and a bottom with a water outlet therein;

a buoyant piston having an air volume therein, and said piston being movably disposed within said tank means and having a perimeter slidably engaging an inside wall of said tank means;

means for enabling water entering the water inlet to pass by the buoyant piston when the buoyant piston is displaced to a selected lower position in said tank means by the entering water, said buoyant piston having sufficient buoyancy to rise to the tank means top from the selected lower position when water is not entering the tank means water inlet; and means, disposed within the buoyant piston, for preventing rupture of the tank means due to thermal expansion of water within the tank means.

11. The plumbing apparatus according to claim 10 wherein the means for preventing rupture of the tank means includes air cushion means for accommodating expansion of water in the tank means.

12. The plumbing apparatus according to claim 11 wherein the air cushion means comprises a diaphragm.

13. The plumbing apparatus according to claim 11 wherein the air cushion means comprises a flexible bladder.

14. A hot water recovery and expansion system comprising:

a hot water heater having a water inlet and a water outlet;

a hot water delivery line connected between said hot water heater and at least one plumbing fixture;

a cold water delivery line connection between said plumbing fixture and a cold water source;

pump means, interconnected between said hot and cold water delivery lines, for circulation of water from the hot water delivery line through the cold water delivery line and into the hot water heater;

control means for causing the pump means to circulate water from the hot water line into the cold water line proximate said plumbing fixture and back to the hot water heater when a hot water valve on said plumbing fixture is turned on;

temperature sensor means, connected to control means, for causing said control means to stop the pump means to prevent heated water from being circulated through the cold water delivery line;

tank means for containing water, said tank means having a top with a water inlet therein connected to the cold water source and a bottom with a water outlet therein connected to the hot water heater inlet;

a buoyant piston having an air volume therein, and said piston being movably disposed within said tank means and having a perimeter slidably engaging an inside wall of said tank means;

means for enabling water entering the tank means water inlet to pass by the buoyant piston when the buoyant piston is displaced to a selected lower position in said tank means by the entering water, said buoyant piston having sufficient buoyancy to rise to the tank means top from the selected lower position when water is not entering the tank means water inlet; and means, disposed within the buoyant piston, for controlling increases in water pressure due to thermal expansion of water in the tank means.

15. The hot water recovery and expansion system according to claim 14 wherein the means for controlling increases in water pressure includes air cushion means for accommodating expansion of water in the tank means.

16. The hot water recovery and expansion system according to claim 15 wherein the air cushion means comprises a diaphragm.

17. The hot water recovery and expansion system according to claim 15 wherein the air cushion means comprises a flexible bladder.

* * * * *